United States Patent [19]

Debetencourt

[11] Patent Number: 4,605,136

[45] Date of Patent: Aug. 12, 1986

[54] SEAL WITH TEAR LIP FOR CONTAINERS

[75] Inventor: Jean Debetencourt, Maulde, Belgium

[73] Assignee: Calwag S.A., Luxemburg, Luxembourg

[21] Appl. No.: 689,247

[22] Filed: Jan. 7, 1985

[30] Foreign Application Priority Data

Jan. 9, 1984 [BE] Belgium ..... 2/60312

[51] Int. Cl.[4] ..... B65D 41/62

[52] U.S. Cl. ..... 215/232

[58] Field of Search ..... 215/232; 220/258, 359

[56] References Cited

U.S. PATENT DOCUMENTS

| | | | |
|---|---|---|---|
| 3,900,125 | 8/1975 | Wyler et al. | 215/341 |
| 4,044,941 | 8/1977 | Knudsen | 215/232 X |
| 4,109,815 | 8/1978 | Collins | 215/232 |
| 4,154,360 | 5/1979 | Smith | 220/258 |
| 4,171,084 | 10/1979 | Smith | 215/232 X |
| 4,209,126 | 6/1980 | Elias | 215/232 X |

*Primary Examiner*—Donald F. Norton

*Attorney, Agent, or Firm*—Fleit, Jacobson, Cohn & Price

[57] ABSTRACT

There is described a seal for container which is provided with a tear lip which is so arranged inside a space between cover and container that on the one hand any contact of the tear lip with the container be avoided, and on the other hand the tear lip lies outside the seal plane, that is outside the induction field.

3 Claims, 3 Drawing Figures

SEAL WITH TEAR LIP FOR CONTAINERS

This invention relates to a seal provided with a tear lip for containers.

More particularly, this invention pertains to such a seal which is connected by thermowelding to the container and whereby said thermowelding is performed by induction heating.

There are indeed known for applying said seals, which are comprised of an aluminum foil provided with a thin layer of thermoweldable material, two main methods, namely the one method whereby the heating occurs by conduction, the so-called heat-welding, and the other method whereby the heating is obtained by induction.

As it is known, the main differences between said methods lie for the so-called heat-welding, in said seal being provided before the cover proper being applied, while for the induction-welding, said seal is applied together with the cover proper, whereafter the heat supply required for the welding of the seal on the container, is obtained by induction.

It is clear that said latter method has a plurality of advantages relative to the first one, mainly because but one operation is required to apply the seal and cover, where this has to occur in two steps with said first method.

It is also known that the removing of said seal is generally cumbersome as there remains but a small free circumferential rim whereon one does not have enough grip for removing the seal, so that said seal generally has to be pushed or cut out.

To obviate said drawback and provide a seal which may easily be removed, it has already been proposed to provide such seals with a tear lip, in other words a projection which may suitably be gripped to tear the seal away from the container.

Such an arrangement has up to now found an actual solution where use is made of said first method, in other words whereby the seal is first secured by heat-welding to apply thereafter the cover, but the arrangement did not appear usable when heating by induction is applied.

Indeed it has been discovered that in said latter case, the seal proper is not only secured to the container but also that the projecting tear lip, as far as it has not already been damaged during the tightening by rotating of the cover proper, is also firmly welded to the container, so that said tear lip is of no use any more.

To retain said tear lip free from the container during the induction-welding, it has already been proposed to form in the location of said lip, a free space by designing the top container edge with an inward slanting. The result thereof is not only that the container opening is markedly reduced, with all the drawbacks connected thereto, but also that the retaining in position of the seal is substantially impossible, while burning of the tear lip is unavoidable. Indeed it is known that it is a property of induction currents to concentrate on the outer circumference of the foil to be heated, the so-called Kelvin effect, so that said lip is burned and becomes useless.

This invention now relates to a seal with tear lip to be secured by induction-welding, whereby the sizes of the container and cover remain the same as in the case where no tear lip is provided, and whereby the container and/or the cover are shaped in such a way that the tear lip is arranged freely between container and cover, so that welding thereof to the container and/or cover is excluded, and whereby the tear lip is located away from the seal plane, in other words outside the induction field, in such a way that damaging thereof by burning is completely avoided.

This invention which has the above features and other ones, is of that kind whereby in the cover is provided a seal proper which is comprised of an aluminum foil which is arranged over thick carboard, and which is provided with a thin layer of thermoweldable material wherewith said seal proper is welded on the container opening by induction-welding, whereby said seal is characterized in that it is provided with a tear lip which is so arranged inside a space between cover and container that on the one hand any contact of the tear lip with the container is avoided, and on the other hand the tear lip lies outside the seal plane, that is outside the induction field.

Other details and features of the invention will stand out from the following description, given by way of non limitative example and with reference to the accompanying drawings, in which.

Figure 1:
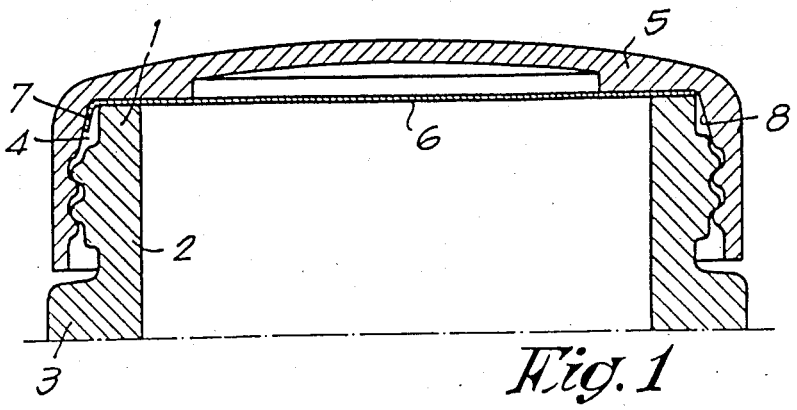
FIG. 1 is a cross-section through the top part of a container which is provided with a seal with tear lip according to the invention.

In FIG. 1 is shown a cross-section of an arrangement according to the invention whereby the diameter of the free end 1 of the neck 2 from a container 3 is so shortened as to form a space 4 between container and cover 5.

There is obtained in this way that a conventional thermoweldable seal 6 with tear lip 7 may be arranged, whereby the lip 7 is automatically located against the inner wall 8 of cover 5, and whereby said lip 7 during the screwing-on of the cover, remains loose from container 2 due to the provision of said space 4.

There is thus obtained that the welding of lip 7 to container 2 be avoided and that said lip 7 be retained out of the seal plane, thus out of the induction field.

Figure 2:
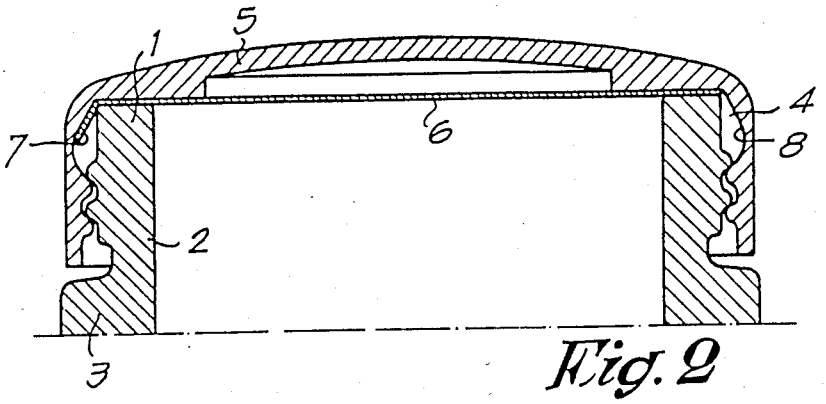
FIG. 2 shows a variation of the object of FIG. 1.
Figure 3:
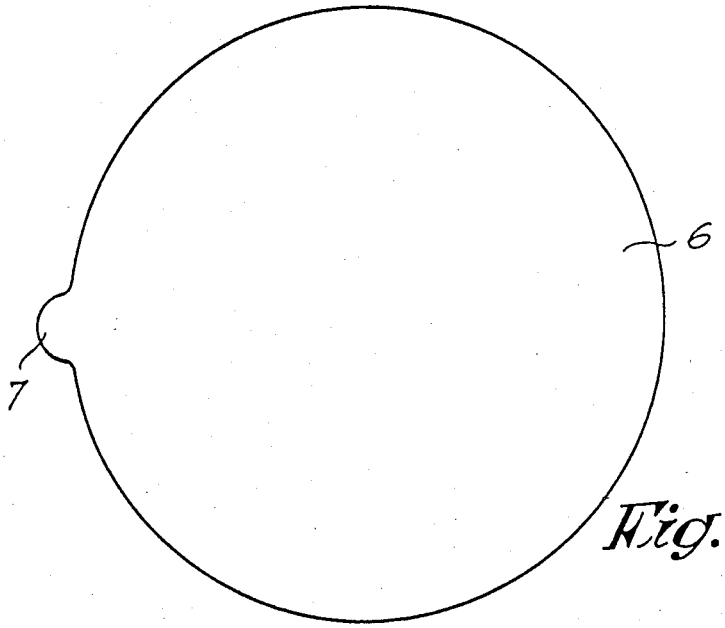
FIG. 3 is a top view of a seal with tear lip as arranged according to the invention.

In FIG. 2 is shown an embodiment wherewith the same advantages are obtained, but whereby the room 4 is formed in cover 5.

It must be understood that the invention is in no way limited to the above embodiments and that many changes may be brought thereto without departing from the scope of the invention as defined by the appended claims.

I claim:

1. A closure assembly for a container, said assembly comprising:

(a) a container having an annular portion that terminates in an annular end to define an opening;

(b) a seal including an aluminum foil sheet having a layer of thermally weldable material applied thereto for adherently sealing said seal to said annular end by the application of heat and pressure, said seal overlying said annular end to close said opening and including an outwardly extending tab having a length sufficient to permit the tab to be manually gripped for removal of said seal from said annular end, said tab extending outwardly away from said annular portion; and (c) a closure including a top wall in overlying relationship with said opening and a depending side wall extending from said top wall and along and over a part of the outer surface of said annular portion, said closure and annular portion including a space therebetween for completely receiving said tab in outwardly spaced relationship to said annular portion of said container.

2. A closure assembly as claimed in claim 1, wherein the outer surface of said annular portion adjacent the end thereof is of reduced diameter to provide the space to receive said tab.

3. A closure assembly as defined in claim 1, wherein the inner diameter of the depending side wall of said closure is greater adjacent said top wall to provide the space to receive said tab.

* * * * *